US006267299B1

(12) United States Patent
Meyer

(10) Patent No.: US 6,267,299 B1
(45) Date of Patent: Jul. 31, 2001

(54) NUTATING SPRINKLER WITH GIMBAL BEARING

(75) Inventor: Larry P. Meyer, Walla Walla, WA (US)

(73) Assignee: Nelson Irrigation Corporation, Walla Walla, WA (US)

( * ) Notice: Subject to any disclaimer, the term of this patent is extended or adjusted under 35 U.S.C. 154(b) by 0 days.

(21) Appl. No.: 09/543,535

(22) Filed: Apr. 5, 2000

(51) Int. Cl.[7] ..... B05B 3/04

(52) U.S. Cl. ..... 239/222.17; 239/222.11; 239/222.21; 239/251.1; 239/232; 239/233; 239/524

(58) Field of Search ..... 239/214, 222, 239/222.11, 222.17, 222.21, 225.1, 231, 232, 233, 236, 461, 518, 524, DIG. 1; 74/18.1; D23/214

(56) References Cited

U.S. PATENT DOCUMENTS

| | | | | |
|---|---|---|---|---|
| 923,443 | * | 6/1909 | Rhodes | 74/18.1 |
| 1,080,111 | * | 12/1913 | Huff | 74/18.1 |
| 1,216,508 | * | 2/1917 | Spade | 74/18.1 |
| 2,639,191 | | 5/1953 | Hruby, Jr. . | |
| 2,848,276 | | 8/1958 | Clearman . | |
| 2,963,228 | | 12/1960 | Hait . | |
| 3,009,647 | | 11/1961 | Hait . | |
| 3,009,648 | | 11/1961 | Hait . | |
| 3,034,728 | | 5/1962 | Hruby, Jr. . | |
| 3,091,400 | | 5/1963 | Aubert . | |
| 3,312,400 | | 4/1967 | Clearman . | |
| 3,532,273 | | 10/1970 | Siddall et al. . | |
| 3,664,585 | | 5/1972 | Curtis . | |
| 3,759,445 | | 9/1973 | King . | |
| 4,011,917 | | 3/1977 | Tiraspolsky et al. . | |
| 4,073,438 | | 2/1978 | Meyer . | |
| 4,134,169 | | 1/1979 | Sinclair . | |
| 4,290,557 | | 9/1981 | Rosenberg . | |
| 4,356,972 | | 11/1982 | Vikre . | |
| 4,487,368 | | 12/1984 | Clearman . | |
| 4,883,228 | | 11/1989 | Vydrzal et al. . | |
| 5,007,586 | | 4/1991 | Cohen . | |
| 5,086,842 | | 2/1992 | Cholet . | |
| 5,381,960 | | 1/1995 | Sullivan et al. . | |
| 5,439,174 | | 8/1995 | Sweet . | |
| 5,588,595 | | 12/1996 | Sweet et al. . | |
| 5,671,885 | | 9/1997 | Davisson . | |
| 5,681,109 | | 10/1997 | Palmer . | |
| 5,762,269 | * | 6/1998 | Sweet | 239/71 |
| 5,765,945 | | 6/1998 | Palmer . | |
| 5,950,927 | | 9/1999 | Elliott et al. . | |

* cited by examiner

*Primary Examiner*—David A. Scherbel
*Assistant Examiner*—Robin O. Evans
(74) *Attorney, Agent, or Firm*—Nixon & Vanderhye P.C.

(57) ABSTRACT

A nutating sprinkler assembly includes a sprinkler body having one end adapted to be coupled to a water supply conduit and an opposite end supporting a nozzle. At least one arm extends from the sprinkler body for supporting a removable cap assembly downstream of the nozzle. The cap assembly supports a gimbal bearing that, in turn, supports a rotor plate with off-center grooves for distributing a stream exiting the nozzle and impinging upon the grooves. A shaft has one end supporting the rotor plate for rotation about a center axis of the rotor plate, and an opposite end supported within the gimbal bearing.

17 Claims, 3 Drawing Sheets

NUTATING SPRINKLER WITH GIMBAL BEARING

TECHNICAL FIELD

This invention relates to sprinkler devices and more specifically, to an improved sprinkler which incorporates a spray plate (or rotor plate) mounted for wobbling/rotating motion referred to herein as "nutation."

BACKGROUND

Moving irrigation systems such as conventional pivot or linear systems are known to incorporate conduit truss span assemblies which mount sprinkler heads, spaced along the truss assemblies for sprinkling or irrigating relatively large areas of land. The sprinkling heads may be mounted on top of the truss assemblies in a normal upright position, or they may be inverted and suspended from the span assemblies by means of drop tubes. Sprinkler heads are typically of the spinner type, which incorporate rotatable stream distributors (also referred to as rotor plates or spray plates, fixed spray plates or bubbler devices).

When irrigating large areas of land with pivot or linear sprinklers, the sprinklers need to be spaced apart as far as possible to minimize system hardware costs. To obtain an even distribution of the water at wide spacings requires sprinklers that simultaneously throw the water long distances and produce sprinkling patterns that are very even when overlapped with adjacent sprinklers. These two requirements are somewhat exclusive in that maximum radius of throw is achieved with concentrated streams of water shooting at relatively high projectory angles. These streams, however, tend to produce a donut shaped sprinkling pattern at low pressure that does not overlap evenly. The use of nutating or wobbling sprinklers to enhance distribution uniformity particularly at low pressure is known in the art, as evidenced, for example, by U.S. Pat. Nos. 5,439,174; 5,671,885; and 5,588,595. Wobbling type sprinklers can be problematic in the sense that in some circumstances, the sprinkler simply rotates on its center axis without wobbling. This is particularly true if the sprinkler rotor plate is allowed to assume an on-center orientation when at rest.

A recently issued patent, U.S. Pat. No. 5,950,927, addresses this problem by mechanically constraining the rotor plate to always assume an off-center position.

SUMMARY OF THE INVENTION

This invention provides an improved rotor plate mounting arrangement which insures that the rotor plate will exhibit the desired nutating motion, particularly on start-up.

In an exemplary embodiment, the rotor plate is supported in a centerbody of a removable cap assembly secured to a sprinkler body, with the rotor plate downstream of a fixed nozzle. The rotor plate is fixed to one end of a shaft, with the other end of the shaft mounted within a two-axis gimbal bearing supported in the cap centerbody. This arrangement allows the rotor plate to rotate about its own axis while the shaft is free to simultaneously pivot about two mutually perpendicular axes, thereby producing a wobbling or nutating action when water is supplied to the sprinkler.

Accordingly, in its broader aspects, the present invention relates to a nutating sprinkler assembly comprising a sprinkler body having one end adapted to be coupled to a water supply conduit and an opposite end supporting a nozzle; at least one arm extending from the sprinkler body for supporting a removable cap assembly downstream of the nozzle, the cap assembly having gimbal bearing supporting a rotor plate having off-center grooves for distributing a stream exiting the nozzle and impinging upon the grooves; a shaft having one end supporting the rotor plate for rotation about a center axis of the rotor plate, and an opposite end supported within the gimbal bearing.

In another aspect, the present invention relates to a nutating sprinkler assembly comprising a sprinkler body having one end adapted to be coupled to a water supply conduit and an opposite end supporting a nozzle; at least one arm extending from the sprinkler body for supporting a removable cap assembly downstream of the nozzle, the cap assembly having a gimbal bearing supporting a rotor plate for rotation about a first axis, the rotor plate having off-center grooves for radially distributing a stream exiting the nozzle and impinging upon the grooves; the shaft having one end in the rotor plate and an opposite end fixed in the gimbal bearing for pivotal movement about second and third mutually perpendicular axes.

DETAILED DESCRIPTION OF THE DRAWINGS

Figure 1:
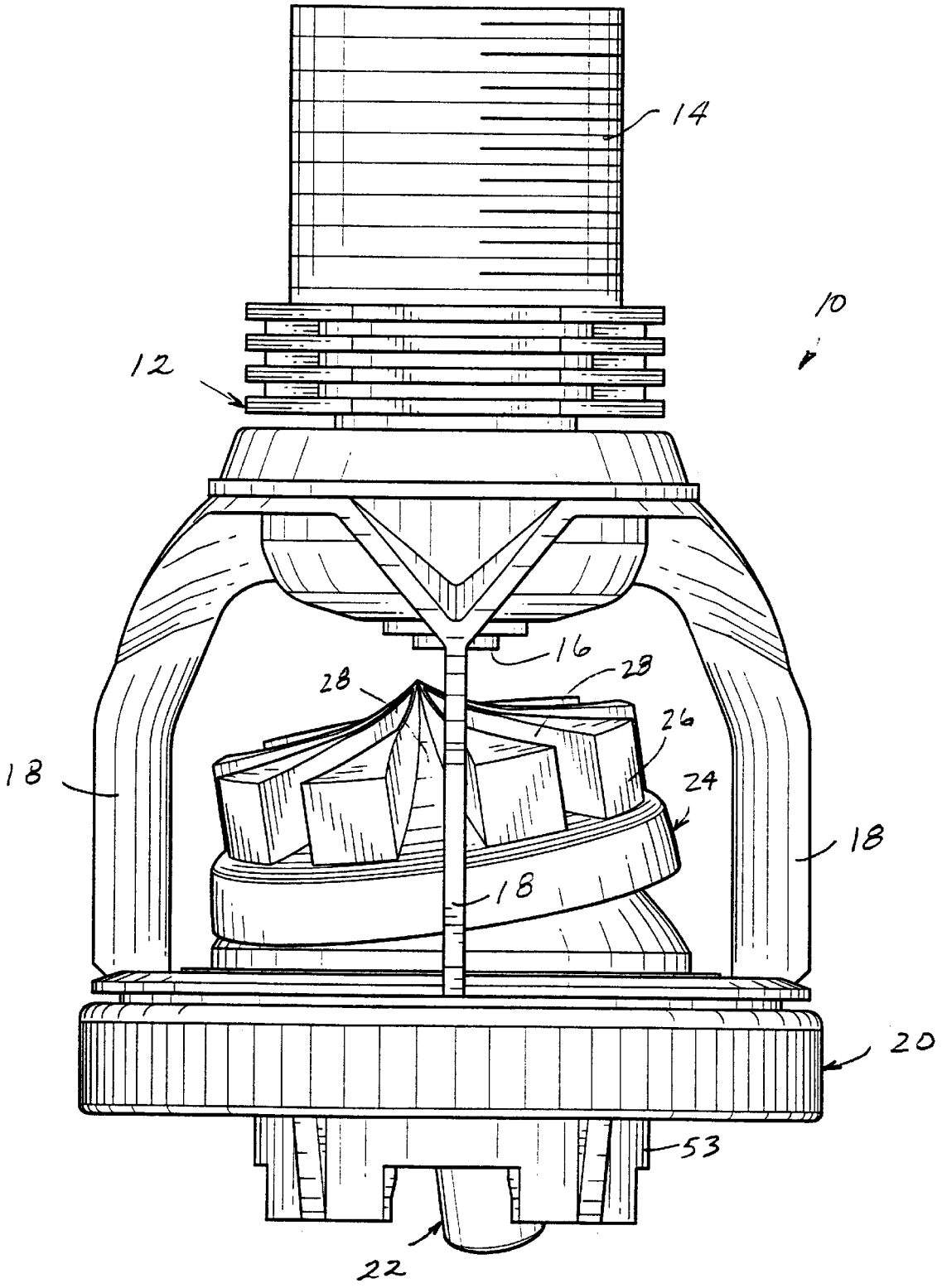
FIG. 1 is a side section of a rotatable sprinkler incorporating a nutating rotor plate in accordance with the first exemplary embodiment of the invention.

Referring to FIG. 1, the sprinkler 10 includes a sprinkler body 12 having a threaded inlet 14 adapted to be secured to a coupling or conduit (not shown). The other end of the sprinkler body supports a fixed nozzle 16. Arms 18 (typically three) extend from the sprinkler body and support a removable cap assembly 20. The cap assembly 20 supports a gimbal bearing assembly 22 that, in turn, supports a rotor plate 24. The rotor plate 24 includes a rotor body 26 having a series of water deflecting grooves 28 therein which are circumferentially offset to cause the rotor plate to rotate when a stream from the nozzle 16 impinges on the grooves 28. A shaft 30, best seen in FIGS. 2 and 3, has one end fixed (axially) within the rotor plate 24 and an opposite end extending from the rotor plate 24 and supported within the gimbal bearing assembly 22. The shaft 30 is retained within the rotor plate 24 by means of a retainer clip 32. The plate 24 rotates about the shaft 30, with a sleeve bearing 34 located within a center opening 36 defined by annular wall 38. The sleeve bearing 34 is held in place by a retainer 40 press fitted into the open end 42 of the wall 38, with a seal 44 between the retainer 40 and sleeve bearing 34. A thrust bearing 45 is located at that end of the shaft fixed in the rotor plate 24.

The gimbal bearing assembly 22 includes a first sleeve 46 which is pivotally mounted at an opposite end of the shaft 30 remote from the rotor plate, for pivotal movement about a first horizontal axis defined by a pin 48 extending through an elongated cap 50 into which the opposite end of the shaft 30 is fixed. Sleeve 46, in turn, is pivotally mounted within a second and larger sleeve 52 by a pair of pins 54, 56 extending from diametrically opposed locations of the first sleeve 46. These pins 54, 56 define a second horizontal axis about which the first sleeve 46 and shaft 30 pivot. The second sleeve 52 is pressed or snap-fitted into a circular opening in the centerbody 53 of the cap assembly 20. Note that the pivot axes defined by pins 48 and 54, 56 lie in a common plane (when the shaft 30 is vertical) but are mutually perpendicular.

In order to insure that the shaft 30 and sleeve 46 will pivot in the desired manner about the pin 48, flexible rubber seals are employed between the shaft cap 50 and the first sleeve 46, and between the first and second sleeves 46 and 52. These seals are diagrammatically indicated at 58, 60 and 62, 64.

An annular skirt 66 extending from the rotor plate 24, and annular surface 68 at the inner end of the cap centerbody 53 cooperate to minimize intrusion of any debris into the area of the gimbal bearing.

When water is supplied to the sprinkler 10, the gimbal bearing arrangement insures that rotor plate 24 will begin nutating (or wobbling) as it rotates about its own axis. The rotor plate 24 has an angled annular surface 70 that reacts with a stationary annular surface 72 on the centerbody 53 to cause the rotor plate to turn (nutate) as water is applied. Because of the diameter differences between surfaces 70 and 72, the grooves in the rotor plate 24 advance slightly with each nutation, thus making the precipitation pattern more uniform. In other words, the gimbal bearing allows the rotor plate to wobble in a smooth, continuous manner as it pivots about mutually perpendicular axes of the bearing while it also rotates about its own axis.

Figure 2:
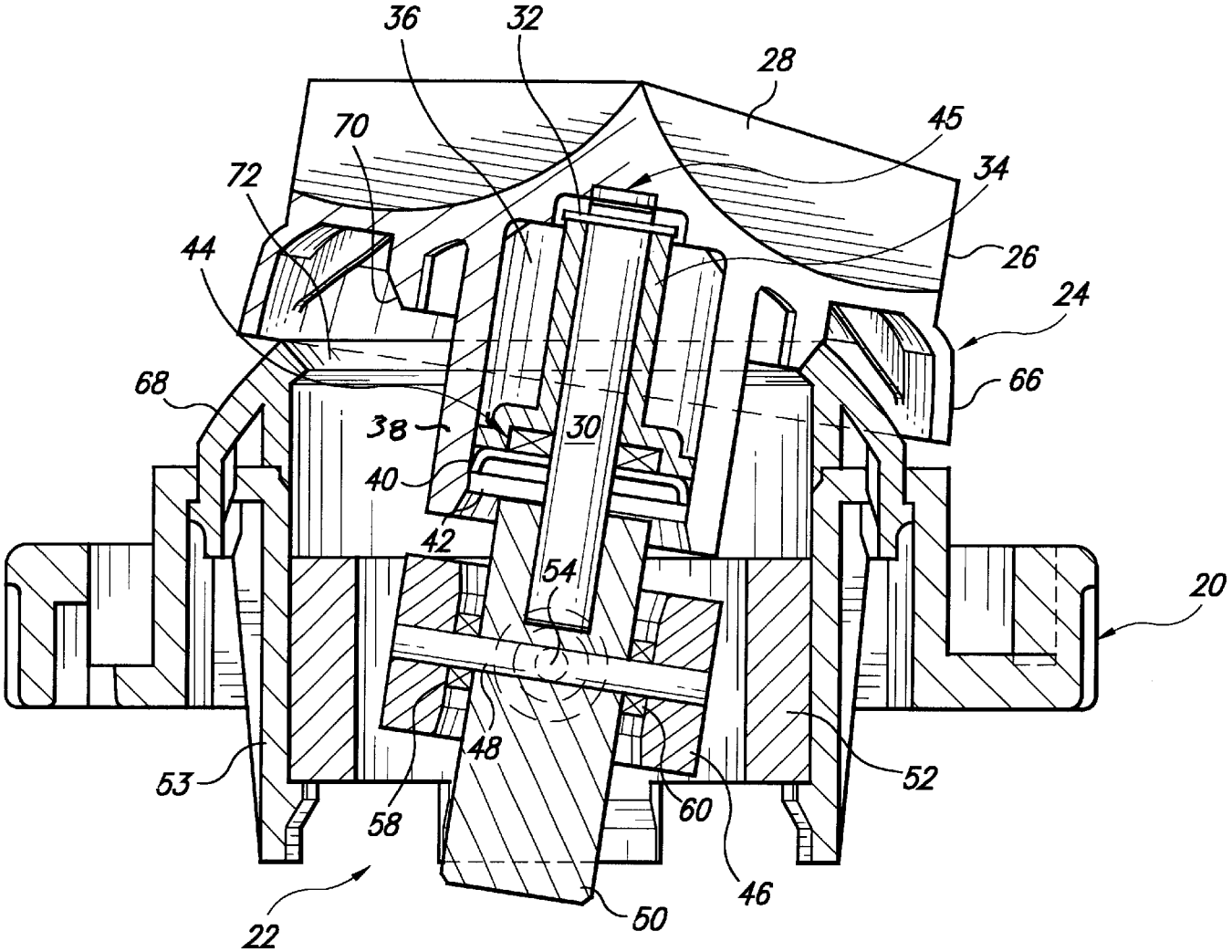
FIG. 2 is an enlarged detail taken from FIG. 1.
Figure 3:
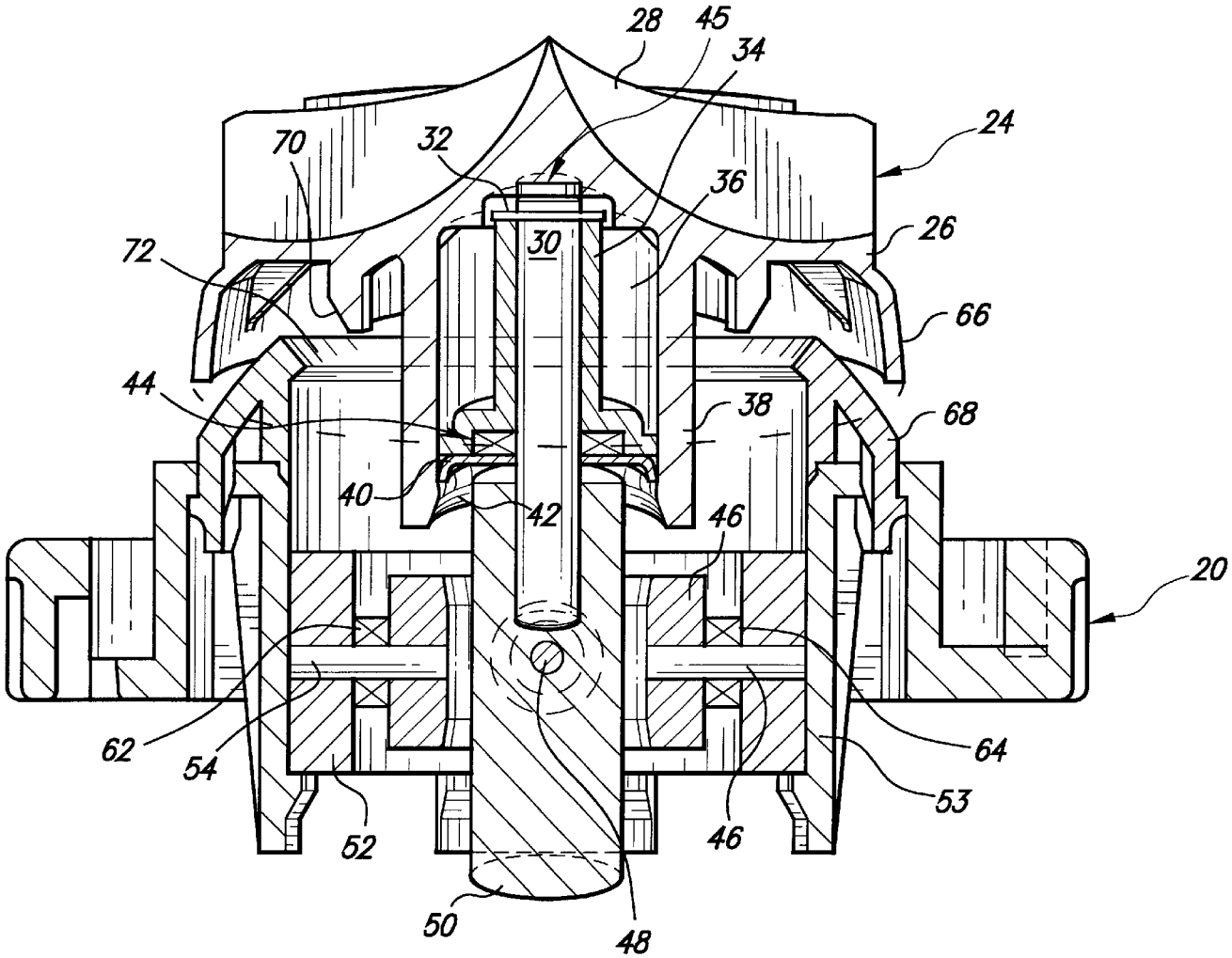
FIG. 3 is an enlarged detail similar to FIG. 2 but rotated 90° about a vertical axis.

While the assembly is shown in FIGS. 1 and 2 so that a stream impinges on the rotor plate 24 from above the rotor plate 24, it will be appreciated that the assembly may be inverted so that the stream impinges on the grooves from below the grooves. The sprinkler nevertheless operates in substantially the same manner as described above. It will further be appreciated that other pivot arrangements may be employed in the gimbal bearing, e.g., integral axes or pins or other suitable means may be employed.

While the invention has been described in connection with what is presently considered to be the most practical and preferred embodiment, it is to be understood that the invention is not to be limited to the disclosed embodiment but on the contrary, is intended to cover various modifications and equivalent arrangements included within the spirit and scope of the appended claims.

What is claimed is:

1. A nutating sprinkler assembly comprising:

a sprinkler body having one end adapted to be coupled to a water supply conduit and an opposite end supporting a nozzle;

at least one arm extending from said sprinkler body supporting a removable cap assembly downstream of said nozzle, said cap assembly having gimbal bearing supporting a rotor plate having off-center grooves for distributing a stream exiting said nozzle and impinging upon said grooves;

a shaft having one end supporting said rotor plate for rotation about a center axis of the rotor plate, and an opposite end supported within said gimbal bearing.

2. The nutating sprinkler assembly of claim 1 wherein said opposite end of said shaft is pivotally mounted within a first sleeve of said gimbal bearing for pivoting motion about a first pivot axis and further wherein said first sleeve is pivotally mounted within a second sleeve of said gimbal bearing for pivoting motion about a second pivot axis substantially perpendicular to said first pivot axis.

3. The nutating sprinkler assembly of claim 2 wherein said second sleeve is snap-fit within said cap assembly.

4. The nutating sprinkler assembly of claim 1 wherein said rotor plate is mounted for rotation relative to said shaft.

5. The nutating sprinkler assembly of claim 1 wherein said shaft is pivotally mounted within said first sleeve by a pin extending from opposite sides of said shaft, and wherein seals are provided on said pins between said shaft and said first sleeve.

6. The nutating sprinkler assembly of claim 5 wherein said first sleeve is pivotally mounted within said second sleeve by a pair of pins extending from opposite sides of said first sleeve, and further wherein seals are provided on said pair of pins between said first sleeve and said second sleeve.

7. The nutating sprinkler assembly of claim 5 wherein said opposite end of said shaft has a diametrically enlarged end cap, and said pin extends through said end cap.

8. The nutating sprinkler assembly of claim 1 wherein said at least one arm comprises three arms substantially equally spaced about said sprinkler body.

9. The nutating sprinkler assembly of claim 1 wherein said rotor plate has a first annular surface engaging a stationary, annular surface provided in said cap assembly.

10. A nutating sprinkler assembly comprising:

a sprinkler body having one end adapted to be coupled to a water supply conduit and an opposite end supporting a nozzle;

at least one arm extending from said sprinkler body supporting a removable cap assembly downstream of said nozzle, said cap assembly having gimbal bearing supporting a rotor plate having off-center grooves for distributing a stream exiting said nozzle and impinging upon said grooves;

a shaft having one end supporting said rotor plate for rotation about a center axis of the rotor plate, and an opposite end supported within said gimbal bearing; and including a seal between said rotor plate and said shaft.

11. A nutating sprinkler assembly comprising:

a sprinkler body having one end adapted to be coupled to a water supply conduit and an opposite end supporting a nozzle;

at least one arm extending from said sprinkler body supporting a removable cap assembly downstream of said nozzle, said cap assembly having gimbal bearing supporting a rotor plate having off-center grooves for distributing a stream exiting said nozzle and impinging upon said grooves;

a shaft having one end supporting said rotor plate for rotation about a center axis of the rotor plate, and an opposite end supported within said gimbal bearing; wherein said rotor plate has a first annular surface engaging a stationary, annular surface provided in said cap assembly; and further wherein said first annular surface has a diameter smaller than said stationary annular surface.

12. A nutating sprinkler assembly comprising:

a sprinkler body having one end adapted to be coupled to a water supply conduit and an opposite end supporting a nozzle;

at least one arm extending from said sprinkler body supporting a removable cap assembly downstream of said nozzle, said cap assembly supporting a rotor plate on one end of a non-rotatable shaft for rotation about a first axis defined by said shaft, said rotor plate having off-center grooves for radially distributing a stream exiting said nozzle and impinging upon said grooves; and a gimbal bearing carried by said cap assembly, wherein said shaft has an opposite end fixed in said gimbal bearing for pivotal movement about second and third mutually perpendicular axes.

13. The nutating sprinkler assembly of claim 12 wherein said opposite end of said shaft is pivotally mounted within a first sleeve for pivoting motion about said second axis and further wherein said first sleeve is pivotally mounted within a second sleeve for pivoting motion about said third axis.

14. The nutating sprinkler assembly of claim 12 wherein said rotor plate has a first annular surface engaging a stationary, annular surface provided in said cap assembly.

15. A nutating sprinkler assembly comprising:

a sprinkler body having one end adapted to be coupled to a water supply conduit and an opposite end supporting a nozzle;

at least one arm extending from said sprinkler body supporting a removable cap assembly downstream of said nozzle, said cap assembly supporting a rotor plate on one end of a non-rotatable shaft for rotation about a first axis defined by said shaft, said rotor plate having off-center grooves for radially distributing a stream exiting said nozzle and impinging upon said grooves; and a gimbal bearing carried by said cap assembly, wherein said shaft has an opposite end fixed in said gimbal bearing for pivotal movement about second and third mutually perpendicular axes; wherein said opposite end of said shaft is pivotally mounted within a first sleeve for pivoting motion about said second axis and further wherein said first sleeve is pivotally mounted within a second sleeve for pivoting motion about said third axis; and further wherein said shaft is pivotally mounted within said first sleeve by a first pin extending from opposite sides of said shaft, and wherein seals are provided on said first pin between said shaft and said first sleeve, and wherein said first sleeve is pivotally mounted within said sleeve by a second pair of pins extending from opposite sides of said first sleeve, and further wherein seals are provided on said pair of pins between said first sleeve and said second sleeve.

16. A nutating sprinkler assembly comprising:

a sprinkler body having one end adapted to be coupled to a water supply conduit and an opposite end supporting a nozzle;

at least one arm extending from said sprinkler body supporting a removable cap assembly downstream of said nozzle, said cap assembly supporting a rotor plate on one end of a non-rotatable shaft for rotation about a first axis defined by said shaft, said rotor plate having off-center grooves for radially distributing a stream exiting said nozzle and impinging upon said grooves; and a gimbal bearing carried by said cap assembly, wherein said shaft has an opposite end fixed in said gimbal bearing for pivotal movement about second and third mutually perpendicular axes; wherein said rotor plate has a first annular surface engaging a stationary, annular surface provided in said cap assembly; and further wherein said first annular surface has a diameter smaller than said stationary annular surface.

17. A nutating sprinkler assembly comprising a sprinkler body supporting a nozzle and a rotor plate supported downstream of said sprinkler body; said rotor plate having a center axis defined by a shaft extending from said rotor plate and received in a gimbal bearing such that said rotor plate is rotatable about said center axis and pivotable about two mutually perpendicular axes within said gimbal bearing.

* * * * *